US009581013B2

(12) United States Patent
Palmer

(10) Patent No.: US 9,581,013 B2
(45) Date of Patent: Feb. 28, 2017

(54) APPARATUS AND METHOD FOR DETERMINING ORIENTATION OF A DEVICE AND MILL POSITION IN A WELLBORE UTILIZING IDENTIFICATION TAGS

(71) Applicant: Larry Thomas Palmer, Spring, TX (US)

(72) Inventor: Larry Thomas Palmer, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 278 days.

(21) Appl. No.: 13/709,698

(22) Filed: Dec. 10, 2012

(65) Prior Publication Data

US 2014/0158351 A1 Jun. 12, 2014

(51) Int. Cl.
*E21B 47/09* (2012.01)
*E21B 47/024* (2006.01)

(52) U.S. Cl.
CPC ..... *E21B 47/024* (2013.01); *E21B 47/09* (2013.01)

(58) Field of Classification Search
CPC ..... E21B 47/09; E21B 47/024; E21B 47/122; E21B 7/061; E21B 43/119
USPC ... 166/255.1, 255.2, 255.3, 117.5, 117.6, 66; 175/61, 79, 81
See application file for complete search history.

(56) References Cited

U.S. PATENT DOCUMENTS 5,035,292 A * 7/1991 Bailey ..... E21B 7/061 175/45
6,192,748 B1 * 2/2001 Miller ..... E21B 7/061 166/117.6
2004/0112595 A1 * 6/2004 Bostick et al. ..... 166/250.01
2006/0108113 A1 * 5/2006 Scott et al. ..... 166/255.1
2008/0185148 A1 8/2008 Carter et al.
2010/0307736 A1 12/2010 Hearn et al.
2011/0199228 A1 * 8/2011 Roddy ..... E21B 33/13 340/856.4
2012/0111636 A1 5/2012 Steele et al.
(Continued)

OTHER PUBLICATIONS

Oxford Dictionary, www.oxforddicitonaries.com/us/definition/american_english/orientation, Accessed on Apr. 18, 2016.*
(Continued)

*Primary Examiner* — Kenneth L Thompson
*Assistant Examiner* — David Carroll
(74) *Attorney, Agent, or Firm* — Cantor Colburn LLP

(57) ABSTRACT

In one aspect, a method of performing an operation in a wellbore is disclosed that in one embodiment may include: placing a first device at a first location in the wellbore, wherein the first device includes a plurality of circumferentially placed tags at known orientations in the wellbore, conveying a second device in the wellbore, the second device including a sensor that provides signals in response to detecting signals from each of the tags in the first device, determining from the signals from the sensor orientation of the second device in the wellbore. In another aspect the method may include a plurality of axially placed tags on a first device and the sensor on a second device, wherein the sensor provides signals when it passes proximate each of the axially spaced tags and determining from the sensor signals location of the second device relative to the first device.

14 Claims, 2 Drawing Sheets

(56) References Cited

U.S. PATENT DOCUMENTS

| | | | | |
|---|---|---|---|---|
| 2012/0152566 | A1 | 6/2012 | Bell | |
| 2013/0248174 | A1* | 9/2013 | Dale | E21B 23/00 166/255.1 |

OTHER PUBLICATIONS

Bolognyy, Leonid et al.; "Multi-Tag RFID Systems," International Journal of Internet Protocol Technology (IJIPT), special issue on "RFID" Technologies, Applications, and Trends, eds. M. Sheng, S. Zeadally, Z Maamar, and M. Cameron, 2007. http://www.cs.virginia.edu/~robins/papers/Multi_Tags_Journal.pdf, pp. 1-13.

International Search Report and Written Opinion dated Feb. 3, 2014 for International Application No. PCT/US2013/069077, pp. 1-15.

* cited by examiner

APPARATUS AND METHOD FOR DETERMINING ORIENTATION OF A DEVICE AND MILL POSITION IN A WELLBORE UTILIZING IDENTIFICATION TAGS

BACKGROUND OF THE DISCLOSURE

1. Field of the Disclosure

The present disclosure relates generally to orienting a tool and performing an operation in a wellbore.

2. Description of the Related Art

Many operations are performed in wellbores for recovery of hydrocarbons (oil and gas) include milling a portion of a casing in the wellbore or forming a lateral wellbore from a main cased or open wellbore. Windows are milled or the lateral wellbores are formed at specified locations in the main wellbore. To perform such a cutting operation, a downhole tool is conveyed in the wellbore that includes a whipstock connected to a cutting device or tool, such as a mill or drill bit. The cutting tool is typically operated by a fluid-driven motor, such as a progressive cavity motor. The downhole tool is rotated to orient the whipstock along the direction where the milling operation is desired to be performed. Once the tool is oriented, an anchor connected below the whipstock is positioned to fixedly set the whipstock along the desired direction. The mill is disengaged from the whipstock and moved along the drill whipstock to contact the wellbore. The mill is rotated to mill a window in the casing and/or to drill a lateral wellbore from the main wellbore. It is desirable to determine the whipstock orientation before setting the anchor and to determine the mill location relative to the whipstock depth (down the whipstock) when milling a window during a casing exit operation.

The disclosure herein provides apparatus and method for orienting the whipstock and determining location of the mill relative to the whipstock in a wellbore.

SUMMARY

In one aspect, a method of performing a downhole operation is disclosed that in one embodiment may include: In one aspect, a method of performing an operation in a wellbore is disclosed that in one embodiment may include: placing a first device at a first location in the wellbore, wherein the first device includes a plurality of circumferentially placed tags at known orientations in the wellbore, conveying a second device in the wellbore, the second device including a sensor that provides signals in response to detecting signals from each of the tags in the first device, determining orientation of the second device in the wellbore from the signals from the sensor.

In another aspect, the method may include conveying a first device having a plurality of axially placed tags on the first device and passing a second device proximate the sensors to provide signals detected from the tags and determining location of the second device relative to the first device sing the signals from the sensor.

In another aspect, an apparatus for performing a downhole operation is disclosed that in one embodiment includes a first device having a plurality of tags axially spaced apart along a length of the first device, a second device having a sensor for proving signals when the sensor is proximate the tags, and a processor for determining location of a selected point on the second device from the signals provided by the sensor when the sensor passes proximate the tags.

In yet another aspect, an apparatus for performing a downhole operation may include a first device for placement at first location in the wellbore, the first device including a plurality of circumferentially placed tags at known orientations in the wellbore, a second device conveyable into the wellbore, the second device including a sensor that provides signals in response to signals provided detected from the tags in the first device, and a processor for determining orientation of the second device from the signals provided by the sensor.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DESCRIPTION OF THE DISCLOSURE

Figure 1:
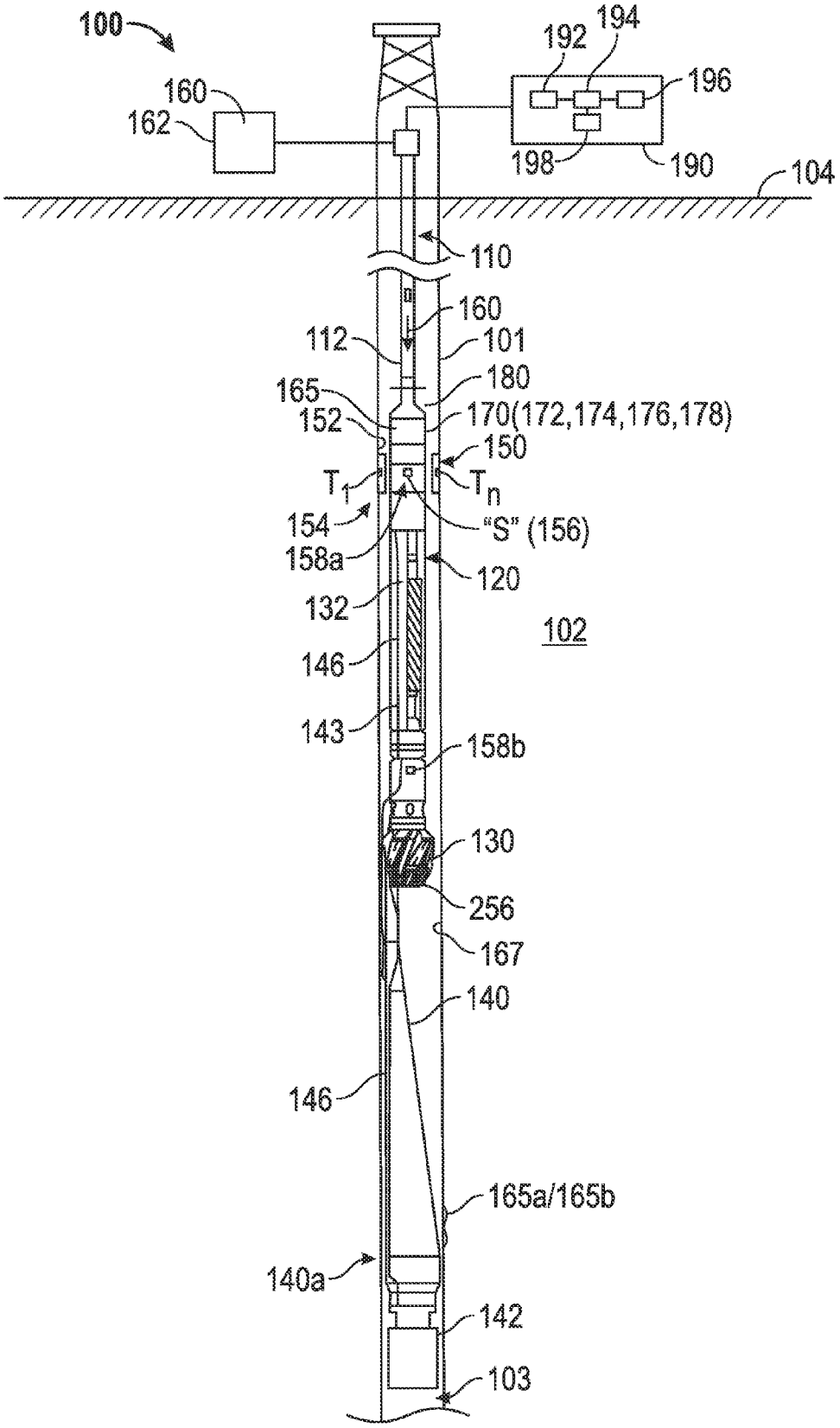
FIG. 1 is a schematic diagram of an exemplary wellbore system for performing an operation in a wellbore, wherein a first device disposed in the wellbore includes a plurality of circumferentially disposed tags and a second device conveyable in the wellbore that includes a sensor that provides signals detected from the tags.

FIG. 1 is a schematic diagram of an exemplary system 100 for performing an operation in a wellbore 101 formed in a formation 102, such as a milling/cutting operation. The system 100 includes drill string or work string 110 placed or conveyed in the wellbore 101 at a desired depth 103. In aspects, the drill string 110 includes a downhole assembly or tool 120 conveyed in the wellbore by a conveying member or tubular 112, such as a coiled tubing or another tubular. The downhole tool 120 includes a cutting device, such as a mill or a drill bit 130 connected to a fluid-operated motor, such as a progressive cavity motor 132. The motor 132 rotates the bit 130 when fluid 160 under pressure is pumped from storage unit 162 at the surface location 104 into the tubular 112. The fluid 160 rotates the motor 132 that, in turn, rotates the bit 130. The downhole tool 120 further includes a detachable whipstock 140 connected to the bit 130 or at another suitable location above or up hole of the bit 130. An anchor 142 is connected below the whipstock 140. In aspects, the anchor 142 may be a hydraulically-set packer or another suitable device. A hydraulic control sub 144 supplies a fluid under pressure to the hydraulically-operated anchor 142 via fluid control line 146 to set the anchor 142.

Still referring to FIG. 1, the downhole tool 120 further includes an orientation device 150 that includes a member 152 placed along an inside of the wellbore 101 at a selected location 154. The member 152 includes a plurality of circumferentially spaced tags T1, T2 through Tn. The tags may be any devices that transmit or radiate active or passive signals that can be detected by a suitable detector or sensor.

In one aspect, the tags are radio frequency identification tags, wherein each such tag transmits a unique radio frequency signal. Each such tag may be battery powered. Alternatively, the tags may be electromagnetic transmitters, acoustic transmitter or any other type of device that transmits known signals. The device 150 may be any device that can be installed or securely placed inside the wellbore 101. For example, the device 150 may be a packer that can be hydraulically or mechanically set or anchored at the location 154. The tags may be placed or embedded along an inner surface of the packer. The device 150 may be any device that can be installed temporarily (for example, removable) or permanently in the wellbore.

Still referring to FIG. 1, the tool 120 further includes a sensor 156 ("S") at a suitable location. One such location may be at the body of the tool 120, such as shown by location 158*a*. Another location may be proximate the bit 130, such as shown by location 158*b*. Any other suitable location on the tool 120 may also be selected for the sensor 156. Also, more than one sensor may be utilized. To set the anchor 140 in the wellbore 101, the device 150 is conveyed by a tool that sets the device 150 in the wellbore and determines the orientation of at least one tag. The tool 120 is then conveyed in the wellbore 102, the sensor S detects one or more of the tags T1 through Tn and transmits the detected tag signals to a controller 170 in the tool 120 and/or a controller 190 at the surface. The signals to the controller 190 may be sent by a telemetry unit 180 in the tool 120. Any suitable telemetry device or system may be utilized, including, but not limited to, acoustic telemetry, electromagnetic telemetry, wired telemetry, and mud pulse telemetry or any other telemetry system known in the art. In one embodiment, the downhole controller 170 includes an electric circuit 172 that pre-processes (for example, amplifies) signals from sensors 152, a processor 174, such as microprocessor, that further processes signals from circuit 172 and transmits the processed signals to the surface controller 190 via the telemetry unit 180. The controller 170 may further include a memory device 176, such as a solid state memory, that stores data and programmed instruction 178 accessible to the processor for processing the signals and performing one or more downhole operations. Similarly, the surface controller 190 may include a circuit 192 that receives and conditions signals transmitted by the device 180, a processor 194, a memory device 196 and programmed instructions 198.

To perform an operation in the wellbore, the tool 120 is conveyed into the wellbore 101, where the sensor 156 transmits signals detected from one or more tags T1, Tn to the controllers 170 and/or 190. The controllers 170 and/or 190 determine the orientation of the tool 120 and thus the whipstock 140 from the sensor signals, since the orientation of the tags relative to the tool 120 and whipstock 140 is known. The tool 120 is then rotated to orient whipstock 140 along a desired direction. The anchor 142 below the whipstock is then hydraulically set by flowing fluid 143 from a source, such as storage unit 162, to the anchor 142 via a fluid line 146. The whipstock bit 130 is then disengaged from the whipstock 140 by applying a mechanical force to break the connection 148. The bit 130, along with the rest of the tool 120, is then free to be moved in the wellbore. The bit 130 is then rotated and moved downhole to perform a desired operation, such as cutting a window 165*a* in the casing 167 in the wellbore or to form a lateral wellbore from a location, such as a location 165*b*. The orientation of the whipstock 140 may be monitored and confirmed by continually processing the signals from the sensor 156.

Figure 2:
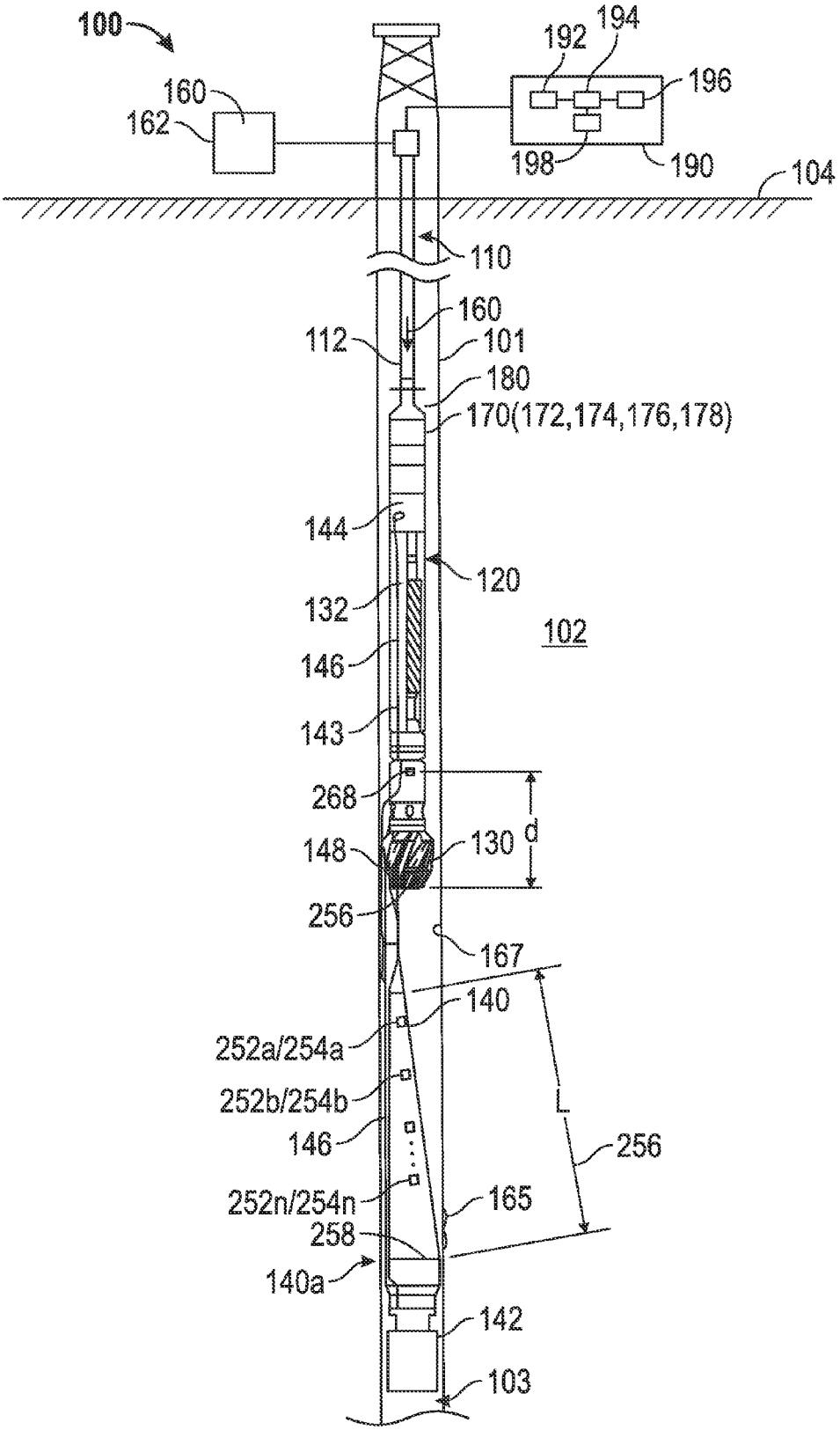
FIG. 2 is a schematic diagram of an exemplary wellbore system for performing an operation in a wellbore, a first device includes a number axially placed tags and a second device including a sensor for providing signals from the tags when the sensor is proximate each of the tags.

FIG. 2 is a schematic diagram of an exemplary wellbore system 200 for performing another operation in a wellbore 101. The system 200 is substantially the same as described in reference to FIG. 1, except that system 200 does not include the circumferentially spaced tags 150, but includes tags along the whipstock 140 as described below. In the system 200, a number of tags 252*a*, 252*b* through 252*n* are axially or serially placed along an axial length "L" of the whipstock 140. The tags 252*a* through 252*n* may be sensed by a suitably positioned sensor in the tool 120, such as sensor 268 positioned a known distance "d" from a bottom 256 of the bit 130. The tags 252*a* through 252*n* are spaced at known distances from a reference point, such as a bottom 258 of the whipstock 140. During performance of an operation using a whipstock 140, it is often desirable to know where the bottom 256 of the bit 130 is located as the bit 130 moves down and along the whipstock 140. This aids an operator at the surface to control the movement and the placement of the bit 130 adjacent to location of the window 165*a*.

Still referring to FIG. 2, once the whipstock 140 has been set in the wellbore and the bit 130 detached from the whipstock 140, the tool 120 and thus the bit 130 is moved downward toward the location of the window 165*a*. As the bit 130 moves, the sensor 268 passes proximate to the tags 252*a*-252*n* and transmits signals to the controller 170 and/or 190 corresponding to the detected tags. The controllers 170 and/or 190 processes the sensor signals and determines the location of a point on the tool 120, such as the bit bottom 256, relative to a location in the well, such as the location of the tag, center of the whipstock, window location 165*a*, etc., and may display such information on a screen or monitor at the surface 104. An operator at the surface may utilizes such information and control the lowering or movement of the bit 130 toward the window location 165*a*.

Referring to FIGS. 1 and 2, the tags 252*a*-252*n* may also be placed on whipstock of FIG. 1 for determining the location of the bit relative to the whipstock for performing an operation in the wellbore. Although, FIGS. 1 and 2 show systems for performing a milling operation using a whipstock, the apparatus and methods for determining or estimating the orientation of a tool downhole and for determining the location of a movable object in the wellbore are equally applicable to bottomhole assemblies used for drilling wellbores and other downhole device for which orientation determination is desired and for which determining the location of a tool relative point in the wellbore is useful.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. A method of performing an operation in a wellbore, comprising:

placing a member at a first location in the wellbore, the member including a plurality of circumferentially spaced tags in a plane perpendicular to a longitudinal axis of the wellbore;

setting the member in the wellbore at the first location;

conveying a tool in the wellbore, the tool including a sensor to provide signals in response to detecting each of the circumferentially spaced tags in the member, wherein an orientation of the plurality of circumferentially spaced tags is known relative to the tool; and processing the signals from the sensor to determine orientation of the tool in the wellbore, wherein the orientation of the tool includes a rotational orientation in response to detecting each of the circumferentially spaced tags.

2. The method of claim 1, wherein the circumferentially spaced tags are selected from a group consisting of: radio frequency identification tags; electromagnetic tags; and acoustic tags.

3. The method of claim 1, wherein the member is removably placed around an inside of the wellbore.

4. The method of claim 1, wherein the tool includes a whipstock and a milling device and wherein performing an operation in the wellbore comprises:

rotating the tool in the wellbore based on the determined orientation of the tool to orient the whipstock; and performing a milling operation with the milling device in the wellbore.

5. The method of claim 1, wherein each tag in the plurality of circumferentially spaced tags transmits a unique signal detected by the sensor.

6. The method of claim 1 further comprising transmitting signals from the sensor to a processor via a telemetry system using telemetry selected from a group consisting of: wireless electromagnetic telemetry; mud pulse telemetry; wireline telemetry; and fiber optic telemetry.

7. The method of claim 4 further comprising:

providing a plurality of axially spaced tags along a length of the whipstock;

passing the milling device along the length of the whipstock;

detecting signals from the axially spaced tags along the length of the whipstock providing signal from the sensor in response to the detected signals; and determining from signals from the sensor in response to the signals detected from the axially spaced tags along the length of the whipstock a location of a point on the tool.

8. The method of claim 7, wherein the point on the tool relates to the milling device.

9. An apparatus for performing an operation in a wellbore, comprising:

a first device for placement at first location in the wellbore, the first device including a plurality of circumferentially spaced tags in a plane perpendicular to a longitudinal axis of the wellbore;

a second device for conveying into the wellbore, the second device including a sensor that provides signals in response to detecting each of the tags in the first device, wherein an orientation of the plurality of circumferentially spaced tags is known relative to the second device; and a processor for determining orientation of the second device from the signals provided by the sensor, wherein the orientation of the second device includes a rotational orientation in response to detecting each of the tags in the first device.

10. The apparatus of claim 9, wherein the tags are selected from a group consisting of: radio frequency identification tags; electromagnetic tags; and acoustic tags.

11. The apparatus of claim 9, wherein the first device is a device configured to be placed around an inside of the wellbore and the second device is selected from a group consisting of: a completion device; and a drilling device.

12. The apparatus of claim 9, wherein the first device is a device configured to be anchored in the wellbore and the second device includes a whipstock and a milling device.

13. The apparatus of claim 9, further comprising a telemetry device for transmitting signals from the sensor selected from a group consisting of: an acoustic transmitter; an electromagnetic transmitter; a mud pulse transmitter; and a transmitter sending signals by a communication link.

14. The apparatus of claim 9, wherein the first device is a whipstock that comprises a plurality of spaced apart tags along a length of the whipstock and wherein the processor is configured to determine location of a point in the second device relative to the whipstock from signals provided by the sensor when the sensor passes proximate the tags along the length of the whipstock.

* * * * *